United States Patent [19]

Weber et al.

[11] 4,451,155

[45] May 29, 1984

[54] MIXING DEVICE

[75] Inventors: Richard B. Weber; George M. Wilfley, both of Denver; George M. Wilfley, Castle Rock, all of Colo.

[73] Assignee: A. R. Wilfley and Sons, Inc., Denver, Colo.

[21] Appl. No.: 459,344

[22] Filed: Jan. 20, 1983

[51] Int. Cl.[3] ..... B01F 7/26

[52] U.S. Cl. ..... 366/265; 366/317; 261/91

[58] Field of Search ..... 366/262, 263, 264, 265, 366/270, 315, 316, 317, 247, 279, 241; 261/84, 92, 91

[56] References Cited

U.S. PATENT DOCUMENTS

| | | | |
|---|---|---|---|
| 1,354,489 | 10/1920 | Johnson | 261/91 |
| 2,626,135 | 1/1953 | Serner | 366/316 |
| 3,273,865 | 9/1966 | White | 261/91 |
| 3,690,621 | 9/1972 | Tanaka | 366/265 |

*Primary Examiner*—Robert W. Jenkins

*Attorney, Agent, or Firm*—Clement and Ryan

[57] ABSTRACT

A mixer for mixing a body of receiving liquid with solids, liquids or gases introduced therein. The mixer includes a rotatable shaft, a thin disk-like member mounted for rotation on the shaft, and at least one thin annular ring mounted on the disk-like member spaced from, parallel to and concentric with it. The flow of liquid perpendicular to the annular ring through the inner opening thereof, when the mixer is immersed and rotating in the body of receiving liquid, is unimpeded by any structural member. The annular ring may be mounted on either side of the disk, and a plurality of annular rings may be employed. The annular ring or rings may be mounted on the disk-like member by at least three elongated support posts spaced equally around the outer perimeter of the disk, the transverse cross-section of each post being curvilinear, preferably circular, in shape. The mixer is disclosed for use in a tank. The vertical position of the rotatable disk-like member in the tank produces a flow pattern in the body of receiving liquid that is characteristic of the particular position selected.

14 Claims, 5 Drawing Figures

MIXING DEVICE

FIELD OF THE INVENTION

This invention relates to a mixer for mixing a body of receiving liquid with sodium particles or objects, another liquid, or a gas or gases, introduced into the receiving liquid.

BACKGROUND OF THE INVENTION

The mixing of one material with another may involve any of several combinations of phases of matter: gas/liquid, liquid/solid, liquid/liquid, miscible liquids and fluid motion. Each of these combinations can be divided into two different types of mixing, in one of which the uniformity of physical dispersion of one material in another is the objective, and in the other a chemical reaction or mass transfer reaction is the objective. A fluid mixer designed for solid suspension is quite different from a mixer designed for heat transfer or gas-liquid mass transfer.

An axial flow pattern is the most efficient if the objective of the mixing is, for example, blending two materials together or producing a solids suspension in a receiving liquid. A thin disk radial turbine is preferred, on the other hand, in chemical reactions or mass transfer reactions, in which reactions a continuous, uninterrupted shear rate is required and turbulence or cavitation must be kept to a minimum.

Thin disk radial mixers produce a flat velocity vector (shear vector) which lies generally in the plane of the disk. The mixing resulting from the use of such a mixer is often called "boundary layer mixing" or "high shear mixing." This type of mixing has the inherent advantages of lower power requirements, higher shear rates, and minimum wear when a liquid is being mixed with small particles of an abrasive solid.

Flat disk mixers are classified as non-cavitation devices because when they are sufficiently thin they substantially eliminate swirls, vortices, and shed roll-ups, which are produced in axial flow turbine type mixers at points of discontinuity (such as at slots, support structure, hub structure, curved surfaces, vanes, etc.) between each mixer blade and the liquid in which it is immersed. The effects of vortex motion (voids, swirls, etc.) feed back to the surface that generated them, creating undesirable cavitation. The result of eliminating or at least minimizing cavitation is to reduce the horsepower required, and to create very little wear on or erosion of the rotating disk even when it is immersed in a body of liquid having small, highly abrasive solid particles suspended therein.

Flat disk mixers in combination with one or more annular rings spaced from and concentric with the disk are known, as for example the prior art device illustrated in FIG. 3 of Serner U.S. Pat. No. 2,626,135 and the agitator disclosed in Tanaka et al. U.S. Pat. No. 3,690,621. Both of these prior art devices failed to recognize the importance of taking care to eliminate all possible sources of cavitation.

In the device shown in FIG. 3 of the Serner patent, the annular rings are mounted on the rotatable shaft by means of radially extending support members or spokes that unavoidably interfere with the axial flow of fluid material perpendicular to the annular rings mounted on the rotatable shaft, which interference is reflected in undesirable turbulence and cavitation at various points along the surface of the rotating disk, as well as a pulsating outwardly directed pumping action that is inconsistent with the basic objectives of the use of a thin radial disk mixer. In the Tanaka et al. agitator, the flat disk is spaced apart from the associated annular ring by a plurality of radially extending blade plates that are purposely designed to produce agitation.

SUMMARY OF THE INVENTION

The present invention provides a highly efficient thin disk radial turbine that produces a substantially uniform and homogenous mixture of small solid particles, liquid droplets or gas bubbles dispersed in a body of receiving liquid. This objective is achieved by eliminating insofar as possible all sources of cavitation in the mixing device.

The mixer of the present invention includes a rotatable shaft, a thin disk-like member mounted for rotation on the rotatable shaft, and a thin annular ring mounted on the disk-like member spaced from, parallel to, and concentric with that member. The ratio of the overall diameter of both the disk-like member and the annular ring to their respective maximum thicknesses is at least about 8:1. The annular ring extends outward approximately to the outer circumference of the disk-like member from a point located generally in the mid-portion thereof. The cross-sections of the outer perimeters of both the disk-like member and the annular ring are tapered to minimum dimensions to produce as uniform boundary layer flow as is possible.

One important feature of this invention is that the flow of liquid perpendicular to the annular ring through the inner opening thereof, when the mixer is immersed and rotating in a body of liquid, is unimpeded by any structural member. The preferred means of mounting the annular ring on the disk-like member is by three or more elongated support posts spaced equally around the outer perimeter of the disk-like member, each of said posts having a transverse cross-section that is curvilinear, and preferably circular, in shape.

The mixer of this invention may include a plurality of thin annular rings having dimensions substantially the same as the first annular ring. For example, one or more additional annular rings may be mounted on the same side of the disk-like member as the side on which the first mentioned annular ring is mounted, with each ring parallel to, concentric with, and equally spaced from the rotatable thin disk-like member and from every other such annular ring. If a particular flow pattern in the body of liquid in which the rotatable disk-like member is immersed is desired, one or more additional annular rings may be mounted on the opposite side of the disk-like member from the first annular ring.

The vertical position of the rotatable disk-like member also determines the particular flow pattern in the body of receiving liquid in certain ways to be described below.

It is preferred that the inboard edge of each annular ring included in the mixer of this invention is tapered in cross-section to a minimum dimension, in order to reduce further any turbulence or cavitation near the inner portions of the mixer.

It is commonly accepted that the minimizing of cavitation in a flat disk mixer is especially important at the outer perimeter of the rotating disk, where boundary layer flow moves away from the rotating disk with both radial and tangential components of flow. It is presumably for this reason that the annular rings associated with the rotating annular disk in the prior art device shown in FIG. 3 of the Serner patent are supported by means of a plurality of spokes extending radially outward from the rotatable shaft, which leaves the spaces between the disk and the adjacent annular ring, as well as the spaces between adjacent annular rings, entirely free of any obstacles to outward liquid flow. However, it has been unexpectedly found that a few small, elongated support posts, preferably round in transverse cross-section with diameters no larger than about 1/60 of the overall diameter of the thin disk-like member, which are positioned at the outer perimeters of the rotating disk and its associated annular ring or rings present only minimal obstruction to boundary layer flow and produce only a minimum of undesirable cavitation effects at those locations. The support posts desirably have as small a transverse dimension as is structurally feasible.

Surprisingly, any undesirable effects at these outer locations that are unavoidable, even with the preferred construction of the indicated support posts, appear to be less troublesome than undesirable cavitation effects caused by the radiating spokes of the device shown in FIG. 3 of the Serner patent, despite the importance of maintaining to the greatest extent possible smooth boundary layer flow throughout the entire circumference of the rotating disk and annular rings. This is true whether the speed of rotation of the disk-like member is as low as 100 r.p.m. or less, or as high as 5000 r.p.m. or even more.

Thus, the trade-off resulting from eliminating all radial spokes and replacing them with a few small, elongated posts at the outer perimeter of the rotating disk and associated annular ring or rings unexpectedly gives significantly improved results with this flat disk mixer.

BRIEF DESCRIPTION OF THE DRAWINGS

The invention will now be described by reference to the accompanying drawings, in which.

DETAILED DESCRIPTION OF SEVERAL EMBODIMENTS

Figure 1:
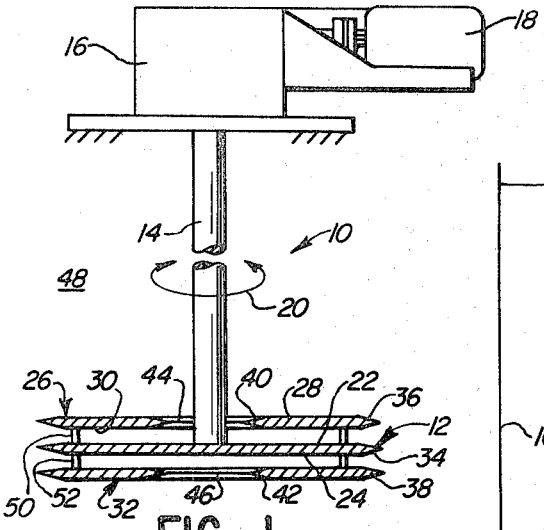
FIG. 1 is a sectional view of one embodiment of the mixer of this invention, in which a thin annular ring is mounted on each side of a thin, rotatable disk-like member.

In FIG. 1, mixer 10 is designed for mixing a body of receiving liquid with small solid particles, liquid droplets, or gas bubbles contained therein. Thin disk-like member 12 is mounted perpendicular to the axis of rotation of rotatable shaft 14 for rotation with the shaft. Shaft 14 is driven by an arrangement of gears in gear box 16, which arrangement is in turn driven by motor 18. As indicated by arrow 20, shaft 14 may be rotated in either angular direction.

The ratio of the overall diameter of the disk-like member to the maximum thickness thereof should be at least about 8:1. The disk should, in fact, be as thin as is structurally feasible. Improved results are obtained if the indicated ratio is at least about 32:1, and it is preferred that it be at least about 128:1. Top surface 22 and bottom surface 24 of member 12 are preferably planar and smooth.

Thin annular ring 26 is mounted on top surface 22 of disk-like member 12 spaced from, parallel to, and concentric with the disk-like member. Again, the disk should be as thin as is structurally feasible. The ratio of the overall diameter of the annular ring 26 to the maximum thickness thereof should be at least about 8:1. Improved results are obtained if the indicated ratio is at least about 32:1, and it is preferred that it be at least about 128:1. Top surface 28 and bottom surface 30 of ring 26 are preferably planar and smooth.

Thin annular ring 32 is mounted on the other side of disk-like member 12, or in other words below that member. Annular ring 32 has substantially the same shape and dimensions as annular ring 26.

Rings 26 and 32 both extend outward approximately to the outer circumference of disk-like member 12 from points located generally in the mid-portion of member 12.

The cross-section of outer perimeter 34 of disk-like member 12 and the cross sections of outer perimeters 36 and 38 of annular rings 26 and 32, respectively, are all tapered to minimum dimensions to produce as uniform boundary layer flow as possible when these members are rotated in a body of receiving liquid. The cross-sections of inner perimeters 40 and 42 of rings 26 and 32, respectively, are also tapered to minimum dimensions to eliminate as much as possible turbulence and cavitation in the receiving liquid adjacent rotating shaft 14.

Inner openings 44 and 46 of annular rings 26 and 32, respectively, are unobstructed by any structural member. As a result, the downward flow of liquid perpendicular to annular ring 26 through opening 44 thereof, and the upward flow of liquid perpendicular to annular ring 32 through opening 46 thereof, both of which take place when the mixer is immersed and rotated in a body of receiving liquid (indicated generally at 48), are unimpeded. This fact minimizes undesirable cavitation in the receiving liquid adjacent the inner portions of disk-like member 12.

Annular ring 26 is mounted on top surface 28 of disk-like member 12 by four elongated support posts 50 spaced equally around outer perimeter 34 of member 12. The transverse cross-section of each post 50 is curvilinear in shape. In the embodiment shown, the cross section of each post is circular in shape. The diameter of each post 50 is preferably no larger than about 1/60 of the overall diameter of disk-like member 12.

Annular ring 32 is supported on the underside of disk-like member 12 by four similar support posts 52.

When the mixer of FIG. 1 is immersed in a body of liquid and rotated, the boundary layer flow resulting from the shape of thin, flat disk 12 minimizes turbulence and cavitation in the portions of the liquid adjacent the outer perimeter of the rotating disk. Thin annular rings 26 and 32 produce improved boundary layer flow in those portions of the liquid, and at the same time these rings render more uniform the outwardly directed pumping action of the rotating disk that accompanies that flow.

To achieve the greatest uniformity in the liquid boundary layer flow and in the accompanying outwardly directed pumping action of rotating disk-like member 12, thin annular rings 26 and 32 should be equally spaced above and below the disk. As already indicated, the mixer of this invention can be used to mix a body of receiving liquid with small solid particles, with another liquid, or with a gas, when any of these is introduced into the receiving liquid. When the material thus introduced is liquid or gas or extremely fine solid particles, disk-like member 12 and annular rings 26 and 32 should be positioned as close to each other as is consistent with the production of boundary layer flow between those members. The spacing between the members in question in such cases will ordinarily be less than about 1/100 of the overall diameter of the disk-like member.

When solid particles or objects larger than the fine solid particles mentioned just above are introduced into the body of receiving liquid—for example, a slurry of sand, a coal slurry, small pebbles, or even larger objects—the spacing of the disk and annular rings must of course be larger. Specifically, the spacing between annular rings 26 and 32, respectively, and disk-like member 12 must be at least as large as the maximum external dimension of the pieces of solid material, and thus may be as large as 2" or even larger. The spacing must be large enough to permit the particles or objects in question to pass between the disk and the associated annular ring and between adjacent pairs of annular rings, and in the case of certain objects must be large enough to avoid bruising or other damage to those objects.

It has been unexpectedly found that a streamlined shape is not the preferred cross-sectional shape for support posts 50 when they are fixed in place. On the contrary, the preferred cross-sectional shape of such posts is circular as in the embodiment of FIG. 1.

As pointed out above, it is commonly accepted that the minimizing of cavitation in a flat disk mixer is especially important around the outer perimeter of the rotating disk. For this reason, it might be expected that support posts having a transverse cross-section in the form of a properly aligned air foil, elongated tear drop, or thin lenticular shape, for example, might product the least interference with boundary layer flow in that area, but a circular cross-section is in fact preferred. Although the exact nature of the phenomenon is not fully understood, it is believed it is simply too difficult to pin down the direction of movement of the flow pattern of the liquid around the rotating supports posts in all conditions of use of this mixer, since the speed of rotation of the disk, the viscosity of the liquid, and the overall diameter of the disk in relation to the width of the tank in which it is contained are all factors that affect the relative direction of movement between the receiving liquid in the tank in which the mixer is immersed and the rotating support posts.

With support posts that are circular in transverse cross-section, the amount of wear on the posts resulting from the rotation of the mixer of this invention in a liquid suspension of even highly abrasive small solid particles (such as a slurry of sand, for example) is surprisingly small. For this reason, support posts 50 may be formed of any hard metal or metal alloy, and do not usually need to be coated with any specially selected abrasion resistant materials such as natural or synthetic rubber or similar polymeric materials.

Figure 2:
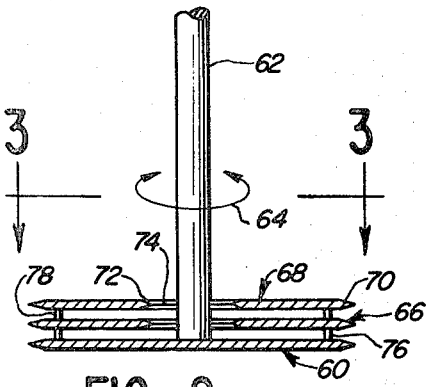
FIG. 2 is a sectional view of another embodiment of the mixer of this invention, in which two thin annular rings are mounted on one side only of a thin, rotatable disk-like member.

In the embodiment of the mixer of this invention illustrated in FIG. 2, thin disk-like member 60 is mounted for rotation on rotatable shaft 62, perpendicular to the axis of rotation of the shaft, for rotation in either of the directions indicated by arrow 64. Disk-like member 60 has substantially the same shape and dimensions as member 12 in the embodiment of FIG. 1.

Annular rings 66 and 68 are mounted on the upper side of disk-like ember 60. Rings 66 and 68 have substantially the shape and dimensions as do annular rings 26 and 32 in the embodiment of FIG. 1. This shape includes among other things tapered perimeter 70 on annular ring 68, and tapered inner perimeter 72 at opening 74 on the same annular ring.

Annular ring 66 is mounted by means of four support posts 76 on disk 60 in the same manner that annular ring 26 is mounted on disk 12 in the mixer of FIG. 1. Annular ring 68 is in turn similarly mounted on annular ring 66, by means of four support posts 78.

Figure 3:
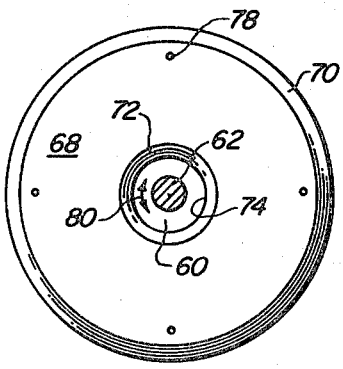
FIG. 3 is a sectional view of the mixer of FIG. 2, taken along the line 3—3 in that Figure.

FIG. 3 is a sectional view of the mixer of FIG. 2 taken along line 3—3 of that Figure. Shaft 62 is rotatable in either of the directions indicated by arrow 80. Rotatable disk-like member 60 is visible through central opening 74 in annular ring 68. The tops of four support posts 78, circular in transverse cross-section, are seen equally spaced around the circumference of annular ring 68.

Figure 4:
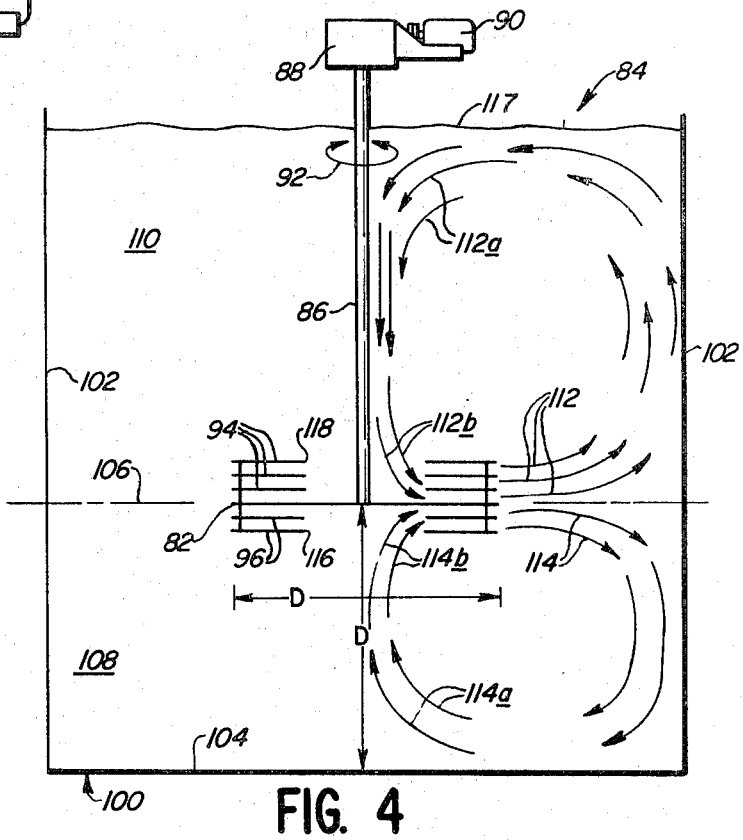
FIG. 4 is a diagrammatic representation of another embodiment of the mixer of this invention, with arrows below and above the plane of the rotatable disk-like member showing certain flow patterns that are followed by the liquid in which the mixer is immersed.

In the diagrammatic showing of FIG. 4, thin disk-like member 82 of mixer 84 is mounted for rotation on rotatable shaft 86 perpendicular to the axis of rotation thereof. Shaft 86 is driven by an arrangement of gears in gear box 88, which arrangement is in turn driven by motor 90. As indicated by arrow 92, shaft 86 may be rotated in either direction, as desired.

In this embodiment, three annular rings 94 are mounted on the upper side of rotatable disk-like member 82. The annular rings are equally spaced from each other and from disk member 82. Each annular ring 94 has substantially the same shape and dimensions as the other annular rings.

Two thin annular rings 96 are mounted on the lower side of disk-like member 82. Rings 96 have substantially the same shape and dimensions as rings 94. Rings 96 are spaced from each other, and the upper ring 96 is spaced from disk-like member 82, the same equal distances as rings 94 are spaced from each other and from member 82.

In the embodiment shown in FIG. 4, tank 100 includes side walls 102 and bottom wall 104. Disk-like member 82 is spaced above tank bottom wall 104 a distance "D" that is at least approximately equal to the overall diameter "D" of member 82.

Horizontal plane 106, in which disk-like member 82 lies, divides the liquid contents of tank 100 into lower portion 108 and upper portion 110. As will be seen, in this embodiment the volume occupied by upper portion 110 of the liquid contents of the tank is roughly half again as large as the volume occupied by lower portion 108.

The pumping action that is directed radially outward by reason of the three upper annular rings 94 is greater than the outwardly directed radial action resulting from the rotation of the two annular rings 96 mounted on the bottom of disk-like member 82. As a result, the larger portion 110 of the liquid contents of the tank is caused to circulate, and mix, to substantially the same extent as lower portion 108 circulates and mixes below plane 106.

The general direction of flow in the right-hand part of upper portion 110 is indicated by arrows 112, and the general direction of the circulation in the right-hand part of lower portion 108 is indicated by arrows 114.

As is indicated by arrows 114, the liquid in portion 108 that is located directly below disk-like member 82 flows—as a result of the rotation of that member at a speed of rotation conventionally employed in thin disk radial mixers—outward to the vicinity of tank side wall 102. It then turns downward toward tank bottom 104, where it turns again and goes inward toward the geometric center of tank bottom wall 104. (As used in this specification and claims, the term "speed of rotation conventionally employed in thin disk radial mixers" is used to mean a speed of rotation that will, regardless of the overall diameter of the rotating disk, give a tip velocity of about 20 ft. per second.) If the speed of rotation of disk-like member 82 is less than this conventional speed, the distance that the flow path represented by arrows 114 in FIG. 4 extends outward beyond the disk will be somewhat less than just described.

As indicated by arrows 114*a*, when the liquid flow reaches the center of tank bottom wall 104, it is deflected upward towards disk-like member 82 by the corresponding, oppositely directed liquid flow from the other side of the tank. The liquid flow rises vertically upward from the center of the tank bottom, and at least a portion of the rising liquid passes through inner openings 116 in thin annular rings 96, and then outward through the spaces between disk-like member 82 and the adjacent ring 96 and between that ring and ring 96 below it. This portion of the liquid flow is represented by arrows 114*b* in FIG. 4. As will be seen, inner openings 116 are free of any structural member that would impede the liquid flow perpendicular to the respective annular rings 96 and thus produce undesirable cavitation in that vicinity.

The general direction of flow of liquid in the right-hand part of upper portion 110 of the contents of tank 100 is indicated by arrows 112. As seen, the flow pattern is in general a horizontal mirror image of the flow pattern in lower portion 108, with the exception that the volume of liquid moved is larger and the liquid flows upward farther (after reaching tank side wall 102) before it turns inward toward the center of tank 100 at surface 117 of the contents of the tank.

As indicated by arrows 112*a*, when the liquid flow reaches the center of the tank, it is deflected downward by the corresponding inwardly directed flow of liquid from the opposite side of the tank. From here the liquid passes down parallel to rotating shaft 86 until it reaches inner openings 118 in annular rings 94. At least a portion of the downwardly moving liquid passes through those openings, as indicated by arrows 112*b*, and then radially outward through the spaces between disk-like member 82 and the annular rings 94, to begin another cycle of movement through upper portion 110 of the liquid contents of the tank.

To simplify FIG. 4, no arrows representing the flow pattern in the receiving liquid 108/110 in tank 100 are included on the left-hand side of the Figure. It will be understood that the flow patterns in the tank contents on the left-hand side of FIG. 4 are substantially vertical mirror images of the flow patterns on the right-hand side of the Figure.

Figure 5:
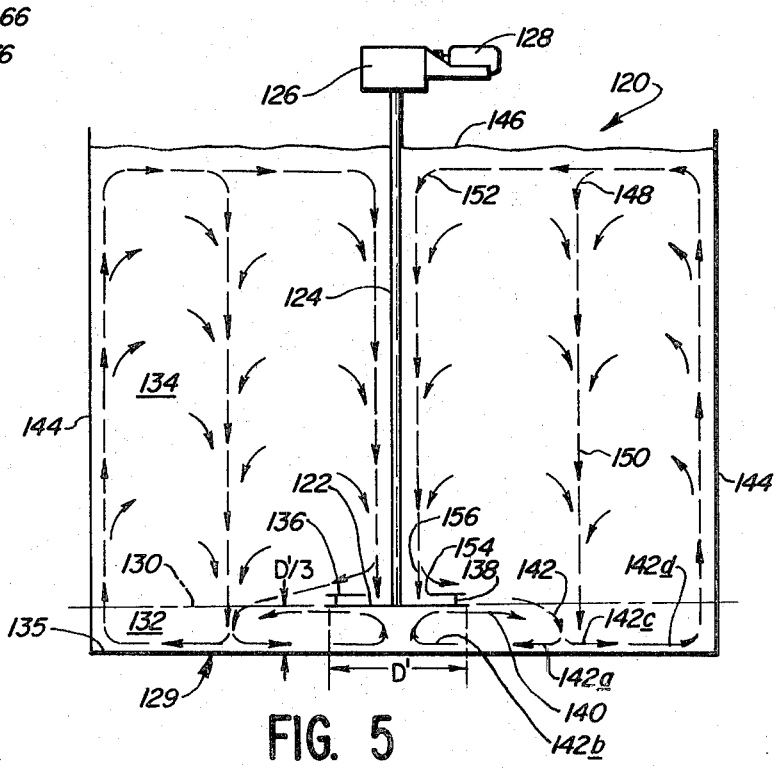
FIG. 5 is a diagrammatic representation of another embodiment of the mixer of this invention, with arrows again showing flow patterns followed by the liquid in which the mixer is immersed.

In FIG. 5, mixer 120 is shown diagrammatically as including thin disk-like member 122 mounted on rotatable shaft 124 for rotation perpendicular to the axis of rotation of the shaft. Shaft 124 is driven by an arrangement of gears in gear box 126, which arrangement is in turn driven by motor 128. Disk-like member 122 is immersed in the liquid contained in tank 129.

Horizontal plane 130, in which disk-like member 122 lies, divides the liquid contents of tank 129 into lower portion 132 and upper portion 134. Disk 122 is spaced above tank bottom wall 135 a distance "D'/3," which is approximately one-third of the overall diameter "D'" of the disk.

In this embodiment, disk-like member 122 carries annular ring 136, mounted on the upper side of the disk through four support posts 138 equally spaced around the circumference of the disk.

The liquid flow in the contents of tank 129 follows a characteristic pattern that is determined by the fact that disk-like member 122 is spaced above tank bottom wall 135 by a distance equal to less than one-half the overall diameter of member 122—in particular, in this instance approximately one-third of that diameter. This flow is shown in FIG. 5.

As there seen, the liquid directly below the disk flows, as a result of the rotation of the disk at a conventional speed of rotation employed in thin disk radial mixers, along path 140 outward beyond the disk-like member a distance of approximately two-thirds of the overall diameter of the disk. The liquid flow path then turns downward at arrow 142 toward the tank bottom, where it splits into two streams, with one stream turning at 142*a* and flowing inward along the tank bottom toward the geometric center of the tank bottom, while the other stream turns at 142*c* and flows outward along the tank bottom.

When the liquid flow reaches the approximate center of the tank, it meets the corresponding, oppositely directed flow from the opposite side of the tank, and turns upward at 142*b* towards rotating disk 122. Upon reaching the disk, the liquid flow is deflected outward and begins its radial outward movement again.

In the meantime, liquid flow continues in an outward direction from arrow 142*c* to arrow 142*d* at tank side wall 144. This flow rises vertically toward top surface 146 of the contents of the tank. Some of the flow turns inward as it rises, and some continues to the surface 146, where it turns inward part way towards the geometric center of the tank. A first portion of this liquid flow turns downward, as indicated by arrow 148, and proceeds along the general path indicated by arrow 150, until it reaches and joins with the liquid flow indicated by arrow 142*c*.

A second portion of the liquid flow directed inwardly towards the tank center at surface 146 continues its inward movement until it reaches the vicinity of rotating shaft 124. There, as indicated by arrow 152, it turns downward and proceeds generally as indicated until it reaches inner opening 154 of annular ring 136, at arrow 156.

Opening 154 is free of any structural member that would impede the downward flow of liquid perpendicular to annular ring 136. At least a portion of the downwardly moving liquid flow passes through opening 154, and then turns outward toward the side wall of the tank.

As indicated above, the liquid flow patterns illustrated in FIG. 5 are characteristic of the patterns produced when the disk-like member of the mixing device of this invention is spaced above the tank bottom wall a distance less than about one-half the overall diameter of the disk. If the disk-like member of the mixer of this invention is spaced above the bottom wall of the tank a distance that is more than about one-half of the overall diameter of the disk but less than one full diameter, the liquid flow in the contents of the tank assumes another characteristic pattern when the disk is rotated at a conventional speed of rotation employed in thin disk radial mixers. In any such case, the path of liquid flow represented by arrows 140 and 142 for the embodiment of FIG. 5 extends outward beyond the disk-like member a distance more than two-thirds of the overall diameter of the disk member, but not out to the tank side wall.

In other words, in any such case arrow 142 will be shifted to the right to a position lying between the position shown in FIG. 5 and tank side wall 144. The resulting pattern of liquid flow in any such case will be generally similar to the flow in the diagrammatic showing of FIG. 5, with arrows 142, 142*c*, 148 and 150 all shifted to the right part way to tank side wall 144.

The vertical position of the rotatable disk-like member in the tank holding the receiving liquid with which the mixer of this invention is to be used will be selected according to the type of liquid flow pattern that is desired for the process in which the mixer is to be used. As has been explained, a characteristic flow pattern is determined by the vertical positioning of the rotatable disk, depending upon whether it is spaced above the tank bottom wall by less than one-half the overall diameter of the disk, by more than one-half that diameter but less than one full diameter, or by one full diameter of the disk or more.

This relationship between the vertical location of the rotatable disk-like member and the level to which the tank is filled with receiving liquid during operation of the mixer is, surprisingly, substantially independent of the width of the tank with which the mixer is used, as well as the resulting spacing between the outer perimeter of the disk and the tank walls.

The above detailed description is given for ease of understanding only. No unnecessary limitations should be understood therefrom, as modifications will be obvious to those skilled in the art.

We claim:

1. A mixer for mixing a body of receiving liquid with solids, liquids or gases introduced therein, which comprises:

(a) a rotatable shaft;

(b) a thin disk-like member mounted for rotation of said rotatable shaft perpendicular to the axis of rotation thereof, the ratio of the overall diameter of said member to the maximum thickness thereof being at least about 32:1, each of the upper and lower surfaces of said disk-like member being substantially planar and smooth from one edge portion of the opposite edge portion and being free of any impeller blades mounted thereon;

(c) at least one thin annular ring mounted on said disk-like member spaced from, parallel to, and concentric with the disk-like member, the ratio of the overall diameter of said annular ring to the maximum thickness thereof being at least about 32:1, said annular ring having a substantially circular inner opening, each of the upper and lower surfaces of said at least one annular ring being substantially planar and smooth from one outer edge portion to the opposite outer edge portion and being free of any impeller blades mounted thereon, the flow of liquid perpendicular to said annular ring through the inner opening thereof, when said mixer is immersed and rotating in said body of liquid, being unimpeded by any structural member, and said annular ring extending outward approximately to the outer circumference of said disk-like member from a point located generally in the mid-portion thereof, whereby improved boundary layer flow is provided at the perimeter of the rotating disk-like member, and the outwardly directed pumping action of the rotatable disk-like member is rendered more uniform.

2. The mixer of claim 1 in which the ratio of the overall diameter of said disk-like member to the maximum thickness thereof, and the ratio of the overall diameter of said annular ring to the maximum thickness thereof, are each at least about 128:1.

3. The mixer of claim 1 in which the cross-sections of the outer perimeters of both said disk-like member and said annular ring are tapered to minimum dimensions to produce as uniform boundary layer flow as possible.

4. The mixer of claim 1 in which the inboard edge of said annular ring is tapered in cross-section to a minimum dimension.

5. The mixer of claim 1 in which said annular ring is mounted on said disk-like member by at least three elongated support posts spaced equally around the outer perimeter of said disk-like member, the transverse cross-section of each of said posts being circular in shape.

6. The mixer of claim 1 in which a second thin annular ring having substantially the same shape and dimensions as said first mentioned annular ring is mounted on said first annular ring on the other side of said first annular ring from said disk-like member, said second annular ring being spaced from, concentric with and parallel to said first annular ring.

7. The mixer of claim 6 in which said second annular ring is mounted on said first annular ring by at least three elongated support posts equally spaced around the perimeter of said first annular ring, each of said support posts having a transverse cross-section that is circular in shape.

8. The mixer of claim 1 which includes a second thin annular ring having substantially the same shape and dimensions as said first mentioned annular ring, said second annular ring being mounted on said disk-like member spaced from, parallel to, and concentric with the same, on the other side of said disk-like member from said first annular ring.

9. The mixer of claim 1 in which a plurality of thin annular rings is mounted on each side of said disk-like member, said rings being spaced from, parallel to and concentric with each other and said disk-like member, and each of said rings having substantially the same shape and dimensions as said first mentioned annular ring.

10. The mixer of claim 9 in which there is a greater number of said thin annular rings mounted on one side of said disk-like member than on the other side thereof.

11. The mixer of claim 1 which includes a tank in which said body of liquid is contained, with said thin disk-like member and said at least one thin annular ring being immersed therein, said tank having a bottom wall and side walls, said disk-like member being spaced above said tank bottom wall a distance less than about one-half said overall diameter of said member, whereby the liquid directly below said disk-like member flows, as a result of the rotation of the disk-like member at a conventional speed of rotation employed in thin disk radial mixers, along a path that extends outward beyond said disk-like member a distance of approximately two-thirds of said overall diameter of the disk-like member and then turns downward toward said tank bottom, where it splits into two streams, with one stream turning and flowing inward along the tank bottom toward the geometric center of said tank bottom wall and the other flowing outward along the tank bottom.

12. The mixer of claim 1 which includes a tank in which said body of liquid is contained, with said thin disk-like member and said at least one thin annular ring immersed therein, said tank having a bottom wall and side walls, said disk-like member being spaced above said tank bottom wall a distance more than about one-half said overall diameter of the disk-like member but less than said overall diameter, whereby the liquid directly below said disk-like member flows, as a result of the rotation of said member at a conventional speed of rotation employed in thin disk radial mixers, along a path that extends outward beyond said disk-like member a distance of more than two-thirds of said overall diameter, but not out to said tank side wall, and then turns downward toward said tank bottom, where it splits into two streams, with one stream turning and flowing inward along the tank bottom toward the geometric center of said tank bottom wall and the other flowing outward along the tank bottom.

13. The mixer of claim 1 which includes a tank in which said body of liquid is contained, with said thin disk-like member and said at least one thin annular ring immersed therein, said tank having a bottom wall and side walls, said disk-like member being spaced above said tank bottom wall a distance at least equal to the overall diameter of said disk-like member, whereby the liquid directly below said disk-like member flows, as a result of the rotation of said member at a conventional speed of rotation employed in thin disk radial mixers, outward to the vicinity of said tank side wall, and then turns downward toward said tank bottom where it turns again and flows inward toward the geometric center of said tank bottom wall.

14. The mixer of claim 13 in which said disk-like member is positioned nearer to said tank bottom wall than to the level to which said tank is filled with receiving liquid during operation of said mixer, and said disk-like member carries at least one thin annular ring on each side thereof, said rings being spaced equally from said disk-like member and each other and parallel to and concentric with the disk-like member, with a larger number of said annular rings on the top side of said disk-like member, than on the bottom side, each of said rings having substantially the same shape and dimensions.

* * * * *